US009093010B2

(12) United States Patent
Hung et al.

(10) Patent No.: US 9,093,010 B2
(45) Date of Patent: Jul. 28, 2015

(54) IMAGE PROCESSING METHOD AND IMAGE PROCESSING APPARATUS

(71) Applicant: MStar Semiconductor, Inc., Hsinchu Hsien (TW)

(72) Inventors: Kuo-Hsiang Hung, Hsinchu Hsien (TW); Pei-Hung Chiu, Hsinchu Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 19 days.

(21) Appl. No.: 14/147,735

(22) Filed: Jan. 6, 2014

(65) Prior Publication Data

US 2014/0192040 A1 Jul. 10, 2014

(30) Foreign Application Priority Data

Jan. 7, 2013 (TW) ..... 102100433 A

(51) Int. Cl.
*G09G 3/36* (2006.01)
*G09G 5/00* (2006.01)
*G09G 3/34* (2006.01)

(52) U.S. Cl.
CPC ..... *G09G 5/006* (2013.01); *G09G 3/3406* (2013.01)

(58) Field of Classification Search
CPC ..... G09G 3/3648; G09G 3/3666
See application file for complete search history.

(56) References Cited

U.S. PATENT DOCUMENTS

| | | | | |
|---|---|---|---|---|
| 7,884,890 | B2 * | 2/2011 | Shimoshikiryoh et al. | 349/39 |
| 2005/0179679 | A1 * | 8/2005 | Hosaka et al. | 345/204 |
| 2010/0309173 | A1 * | 12/2010 | Matsuda et al. | 345/204 |

* cited by examiner

*Primary Examiner* — Andrew Sasinowski
(74) *Attorney, Agent, or Firm* — Edell, Shapiro & Finnan, LLC

(57) ABSTRACT

An image processing method is disclosed according to one embodiment of the present invention. The method comprises receiving an image according to a first timing signal having at least one first active pixel time period, at least one first horizontal blanking time period and a first vertical blanking time period; and outputting the image according to a second timing signal having at least one second active pixel time period, at least one second horizontal blanking time period and a second vertical blanking time period. A pixel number corresponding to the first active pixel time period equals to a pixel number corresponding to the second active pixel time period. The second horizontal blanking time period is less than the first horizontal blanking time period. The second vertical blanking time period is larger than the first vertical blanking time period.

12 Claims, 9 Drawing Sheets

IMAGE PROCESSING METHOD AND IMAGE PROCESSING APPARATUS

CROSS REFERENCE TO RELATED APPLICATIONS

This application claims priority under 35 U.S.C 119 to Taiwan patent application, TW102100433, filed on Jan. 7, 2013, the disclosure of which is incorporated herein by reference.

BACKGROUND OF THE INVENTION

1. Field of the Invention

The present invention relates to image processing method and apparatus, and more particularly, to image processing method and apparatus for reducing image crosstalk.

2. Description of the Prior Art

FIG. 1 depicts a diagram showing relations between active pixel area (image pixel area), horizontal blanking area, and vertical blanking area in the prior art. And FIG. 2 depicts a timing sequence diagram of image transmission in the prior art.

Please refer to FIG. 1, an image frame Fr usually comprises a first active pixel area $AP_1$ which consists of multiple active pixel rows such as $AP_{11}$ and $AP_{12}$ (only two rows are shown). Besides, in order to guarantee the success of image transmission, a first horizontal blanking area $HB_1$ and a first vertical blanking area $VB_1$ are provided switching lines and frames during the image transmission. The first horizontal blanking area $HB_1$ comprising multiple horizontal blanking pixel rows such as $HB_{11}$ and $HB_{12}$ (only two rows are shown) is vertical for the switches between active pixel rows. The first vertical blanking area $VB_1$ comprising multiple vertical blanking pixel rows such as $VB_{11}$ and $VB_{12}$ (only two rows are shown) is vertical for the switches between image frames.

Please refer to FIG. 2, the image frame Fr is conventionally transmitted according to a first timing signal $PCLK_1$. The first timing signal PCLK1 comprises at least one first active pixel time period $A_1$, at least one first horizontal blanking time period $H_1$, and a vertical blanking time period $V_1$. During each of the first active pixel time periods $A_1$, one active pixel row is transmitted. After one active pixel row is transmitted, no data is transmitted during the adjacent first horizontal blanking time period $H_1$, and then the transmission of a next active pixel row follows. Take the example shown in the FIG. 2, the active pixel row $A_{11}$ is transmitted during the first active pixel time period $A_1$. After that, no data transmission happens during the adjacent first horizontal blanking time period $H_1$. And it follows that the next active pixel row $A_{12}$ is transmitted during an adjacent first active pixel time period $A_1$. The rest of active pixel rows are transmitted in similar way. After all active pixel rows are transmitted, data transmission is paused during the first vertical blanking time period $V_1$. And then, the transmission of next image frame follows. Therefore, the number of pixels corresponding to each of first active pixel time period $A_1$ is equal to the number of pixels in each of the first active pixel rows such as $AP_{11}$ and $AP_{12}$. The number of pixels corresponding to the first horizontal blanking time period $H_1$ is equal to the number of pixels in each of the first horizontal blanking pixel rows such as $HB_{11}$ and $HB_{12}$. The number of pixels corresponding to the first vertical blanking time period $V_1$ is equal to the sum of numbers of pixels in all of the first vertical blanking pixel rows such as $VB_{11}$ and $VB_{12}$.

In details, a backlight module of a display only is turned on during first vertical blanking time periods in some applications such as simulated impulse type liquid crystal displays or 3D displays. In other words, after a first image frame (i.e., the active pixel area) is already shown on the display, the backlight module of the display is turned on at a timing point within the first one of the first vertical blanking time periods. Until the end of the first one of the first vertical blanking time periods, the backlight module of the display is turned off. Following that, a second image frame is shown on the display. Similarly, the backlight module of the display is turned on at a timing point within the second one of the first vertical blanking time periods. The backlight module of the display is turned off while the end of the second one of the first vertical blanking time periods. And the described cycle goes on and on. User's eyes perceive the image frame while the backlight module is lighted. Since some characteristics carried by liquid crystal itself, a transformation between different pixel data (for example from pixel data A to pixel data B) needs some time for raising or descending of signal voltage levels. Therefore what eyes perceive is a mixture of pixel data A and pixel data B in a certain proportion. Ideally, the proportion of A versus B is 0% versus 100%, i.e., no prior image frame should be perceived by user's eyes. However, due to the characteristics of liquid crystal, the ideal situation may not happen as wishes. Therefore the proportion of data mixture phenomenon is called "crosstalk."

From the above it is clear that prior art still has shortcomings. In order to solve these problems, efforts have long been made in vain, while ordinary products and methods offering no appropriate structures and methods. Thus, there is a need in the industry for a novel technique that solves these problems.

SUMMARY OF THE INVENTION

Consequently, one of objectives of the present invention is to provide an image processing method and an image processing apparatus for avoiding image crosstalk.

An image processing method is disclosed according to one embodiment of the present invention. The method comprises receiving an image according to a first timing signal having at least one first pixel time period, at least one first horizontal blanking time period and first vertical blanking time period; and outputting the image according to a second timing signal having at least one second active pixel time period, at least one second horizontal blanking time period and a second vertical blanking time period. A pixel number corresponding to the first active pixel time period equals to a pixel number corresponding to the second active pixel time period. The second horizontal blanking time period is less than the first horizontal blanking time period. The second vertical blanking time period is larger than the first vertical blanking time period.

An image processing apparatus is disclosed according to one embodiment of the present invention. The image processing apparatus comprises a controller and a storage. The controller are configured to control the storage for receiving an image according to a first timing signal having at least one first active pixel time period, at least one first horizontal blanking time period and a first vertical blanking time period, and to control the storage for outputting the image according to a second timing signal having at least one second active pixel time period, at least one second horizontal blanking time period and a second vertical blanking time period. A pixel number corresponding to the first active pixel time period equals to a pixel number corresponding to the second active pixel time period. The second horizontal blanking time period is less than the first horizontal blanking time period.

The second vertical blanking time period is larger than the first vertical blanking time period.

By shortening the horizontal blanking time periods, the rising or falling of signal voltage level between different pixel data happens earlier accordingly. When the backlight module is turned on, the eyes perceive more latter data (pixel data B) and less former data (pixel data A). So the crosstalk phenomenon is alleviated accordingly. By this way, the crosstalk issue can be improved in the consequence. Moreover, approaches for determining the number of vertical blanking pixel rows according to the remainder pixels is disclosed, the present invention provides more design flexibility.

The above description is only an outline of the technical schemes of the present invention. Preferred embodiments of the present invention are provided below in conjunction with the attached drawings to enable one with ordinary skill in the art to better understand said and other objectives, features and advantages of the present invention and to make the present invention accordingly.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
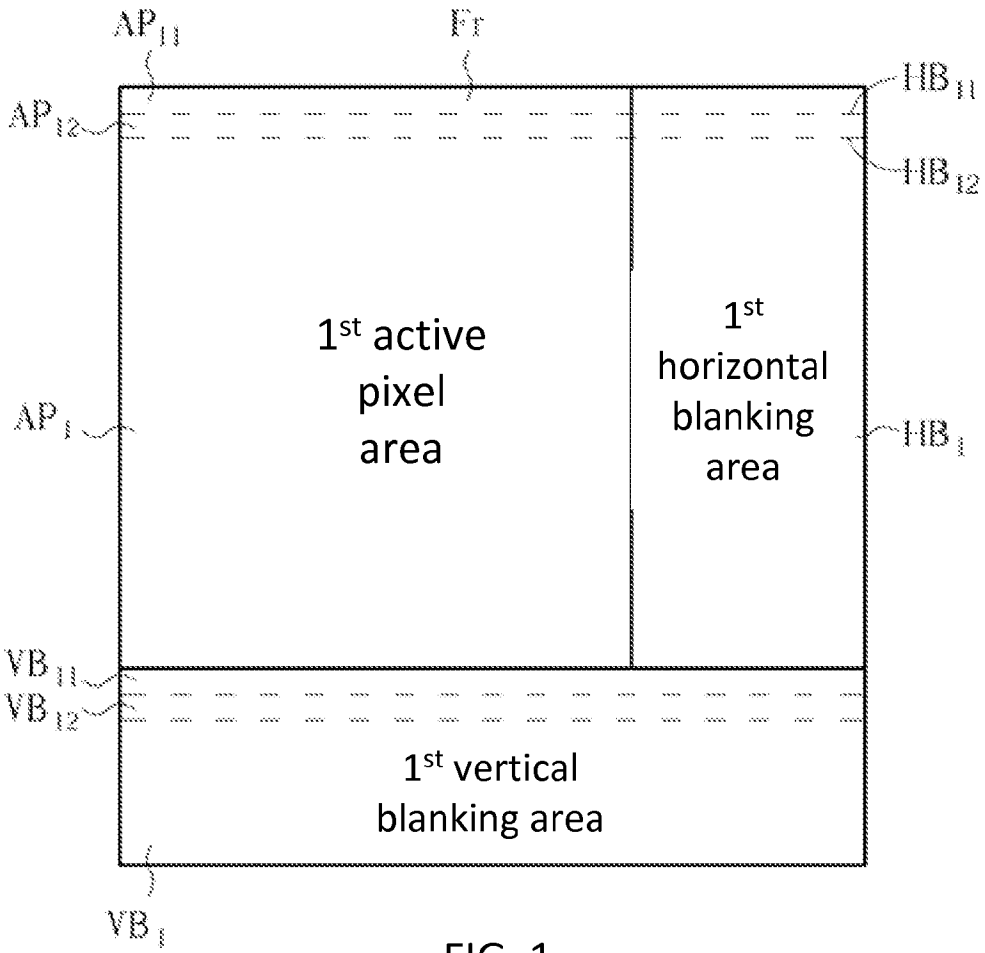
FIG. 1 (Prior Art)
FIG. 1 depicts a diagram showing relations between active pixel area, horizontal blanking area, and vertical blanking area in the prior art.

Some embodiments of the present invention are described in details below. However, in addition to the descriptions given below, the present invention can be applicable to other embodiments, and the scope of the present invention is not limited by such, rather by the scope of the claims. Moreover, for better understanding and clarity of the description, some components in the drawings may not necessary be drawn to scale, in which some may be exaggerated relative to others, and irrelevant parts are omitted.

Figure 2:
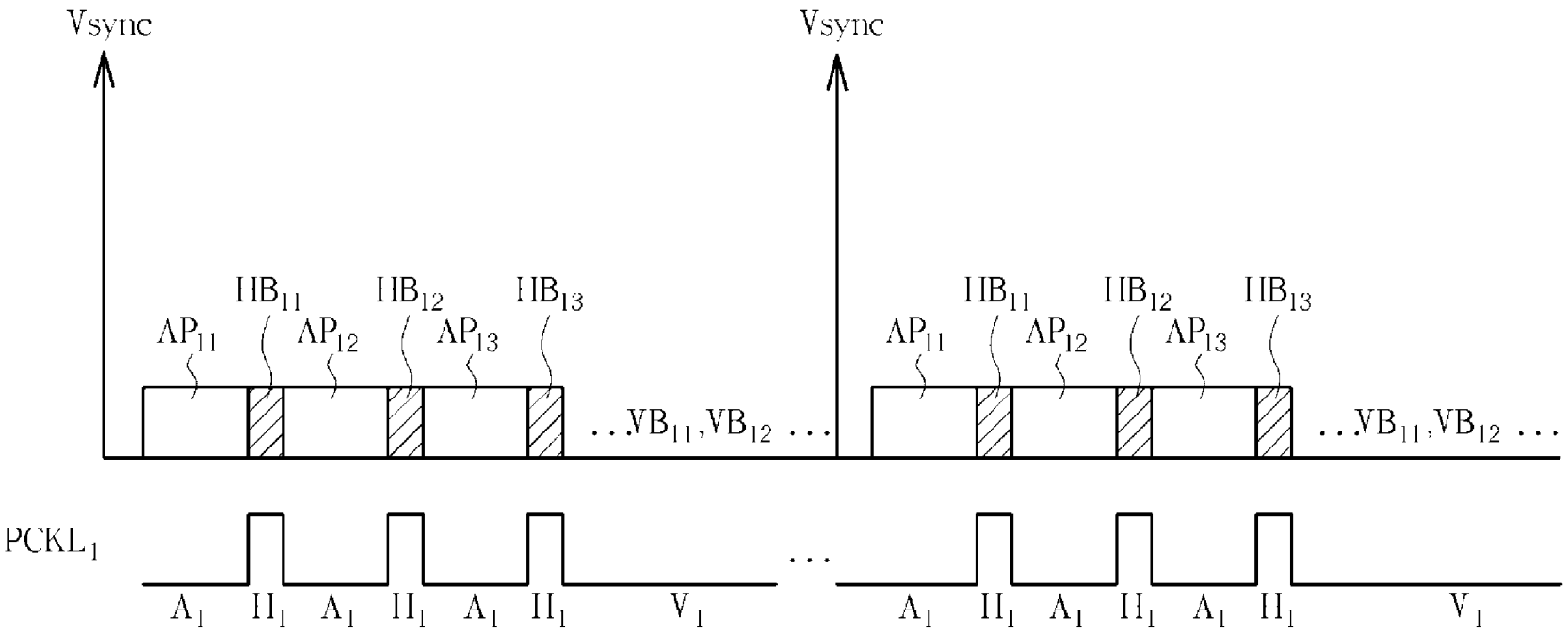
FIG. 2 (Prior Art)
FIG. 2 depicts a timing sequence diagram of image transmission in the prior art.
Figure 3:
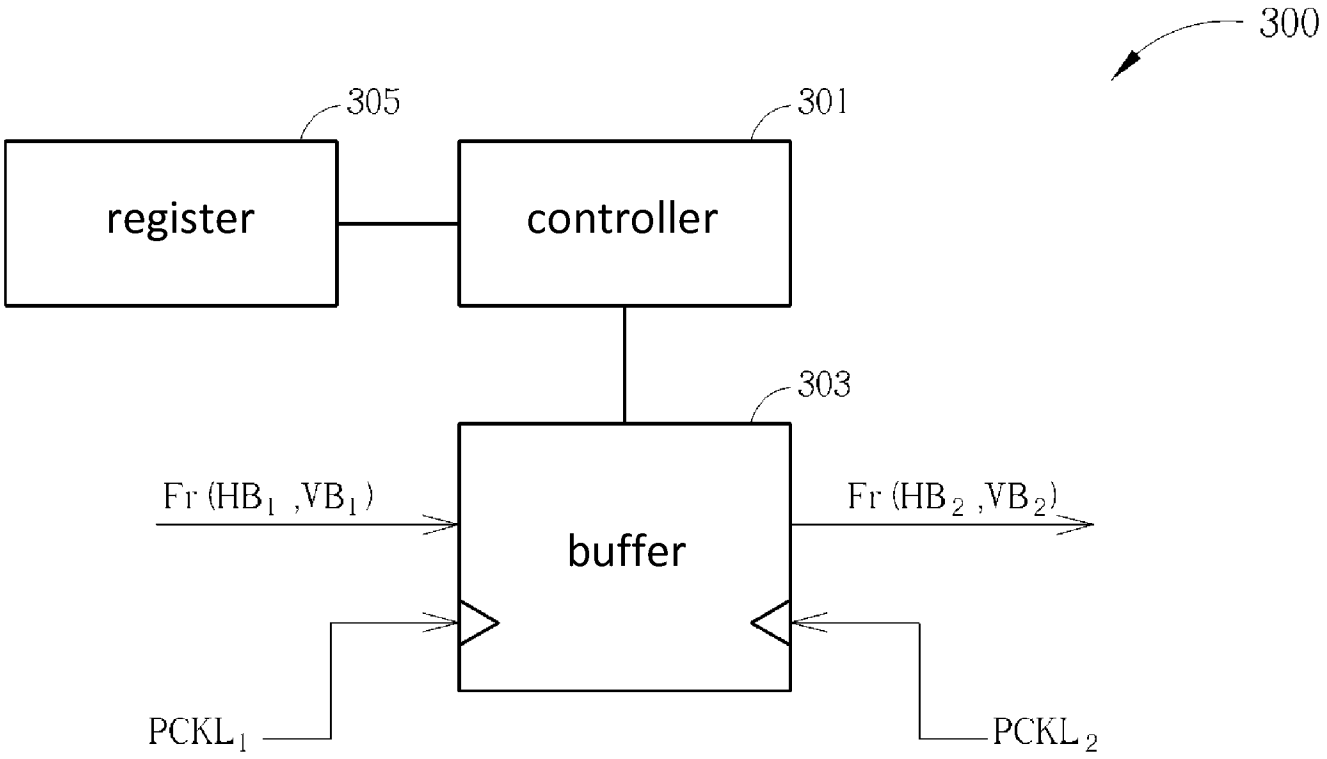
FIG. 3 illustrates a block diagram of an image processing apparatus in accordance with an embodiment of the present invention.

FIG. 3 illustrates a block diagram of an image processing apparatus 300 in accordance with an embodiment of the present invention. Please be aware that the apparatus shown in the FIG. 3 is exemplary, it is not intended to limit the scope of the present invention. Besides, the embodiment also incorporates the image frame Fr and the first timing signal PCLK1 shown in the FIG. 1 and FIG. 2 in the description of transmission steps before adjustment. However, it is not intended to limit the present invention to the transmission steps shown in the FIG. 1 and FIG. 2.

As shown in the FIG. 3, the image processing apparatus 300 comprises a controller 301 and a buffer 303 (i.e., a storage apparatus). The controller 301 is configured to control the buffer 303 receiving the image frame Fr according to the first timing signal PCLK1 and to control the buffer 303 outputting the image frame Fr according to a second timing signal $PCLK_2$. Since a second horizontal blanking time period and a second vertical blanking time period of the second timing signal $PCLK_2$ are not the same as the first horizontal blanking time period and the first vertical blanking time period of the first timing signal $PCLK_1$, respectively, the image frame Fr is received according to the first horizontal blanking area and the first vertical blanking area (for example, $HB_1$ and $VB_1$ shown in the FIG. 1, respectively) and outputted according to a second horizontal blanking area and a second vertical blanking area (for example, $HB_2$ and $VB_2$ shown in the FIG. 4, respectively.)

Figure 4:
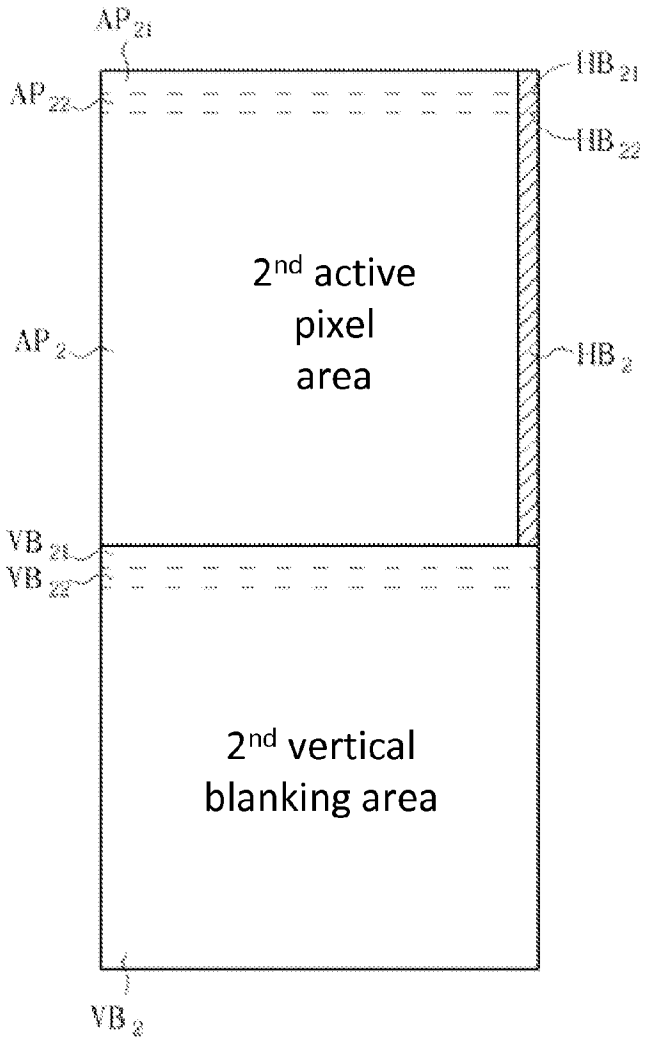
FIG. 4 illustrates a diagram showing relations between horizontal blanking area and vertical blanking area corresponding to the image processing method in accordance with an embodiment of the present invention.
Figure 5:
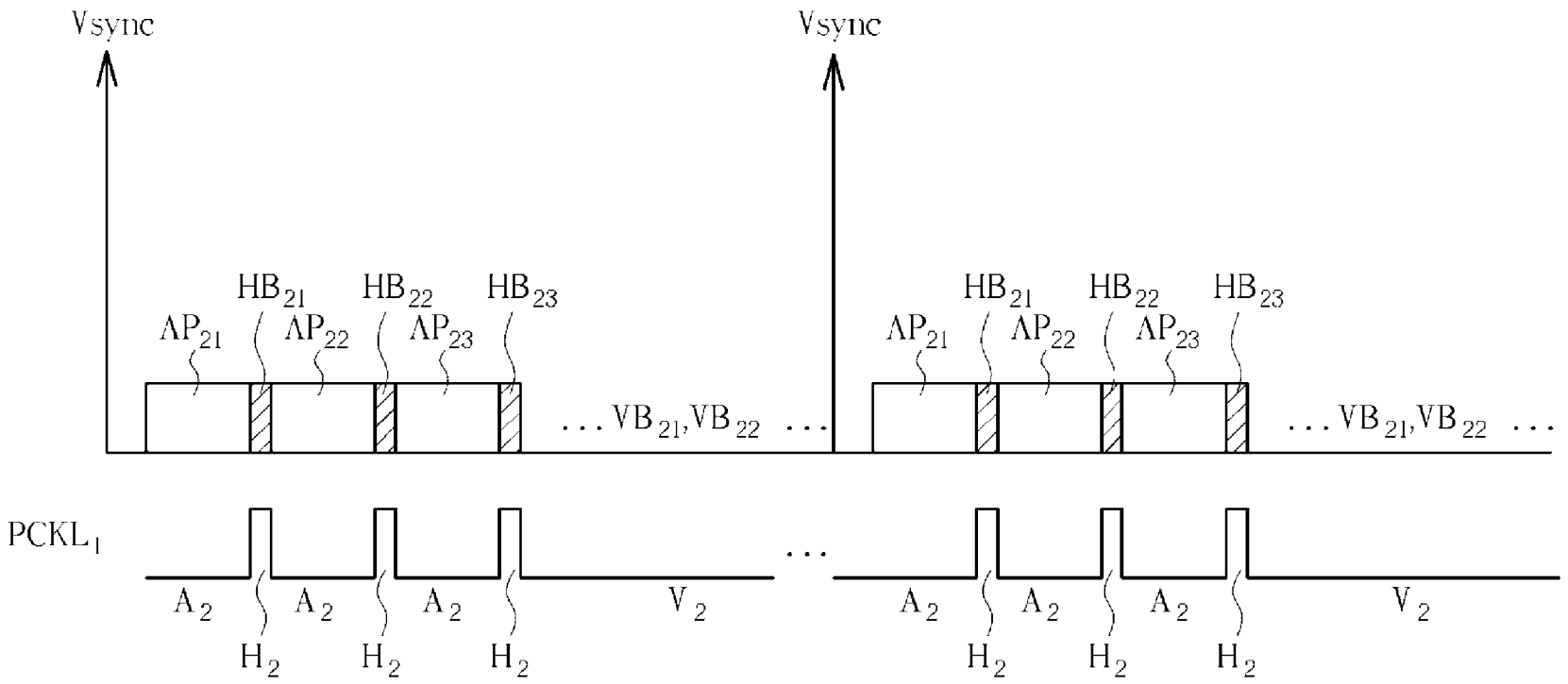
FIG. 5 depicts a diagram illustrating image transmission embodied an image processing method in accordance with an embodiment of the present invention.
Figure 6:
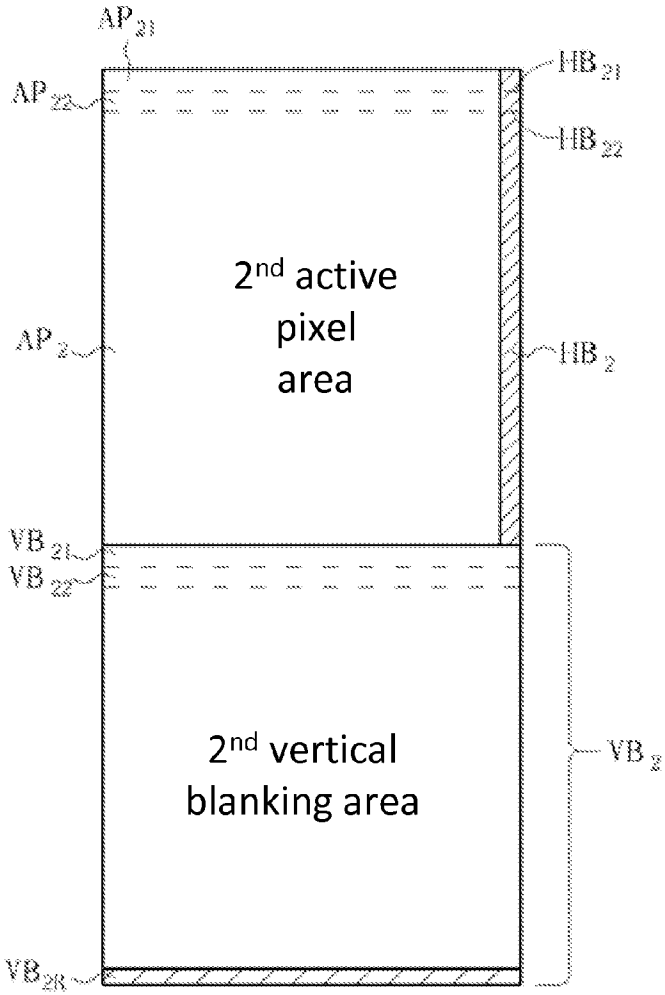
FIG. 6 illustrates a diagram showing relations between horizontal blanking area and vertical blanking area of an image processing method in accordance with another embodiment of the present invention.

FIG. 4 illustrates a diagram showing relations between horizontal blanking area and vertical blanking area of an image processing method in accordance with an embodiment of the present invention. FIG. 5 depicts a diagram illustrating image transmission embodied an image processing method in accordance with the embodiment of the present invention. Please be noted that the FIG. 4 is incorporated in the description of image outputting actions shown in the FIG. 5. It is not intended to limit the scope of the present invention to the image data format shown in the FIG. 4. Please refer to FIG. 4 and FIG. 5 crossly for better understanding of the present invention.

As shown in the FIG. 5, the second timing signal $PCLK_2$ comprises at least one second active pixel time period $A_2$, at least one second horizontal blanking time period $H_2$, and a second vertical blanking time period $V_2$. Similarly, functions of the second active pixel time period $A_2$, the second horizontal blanking time period $H_2$, and the second vertical blanking time period $V_2$ are analogous to that of the first active pixel time period $A_1$, the first horizontal blanking time period $H_1$, and the first vertical blanking time period $V_1$, respectively. Number of pixels corresponding to each of the second active pixel time periods $A_2$ equals to number of pixels in each of the second active pixel rows such as $AP_{21}$ and $AP_{22}$. Number of pixels corresponding to the second horizontal blanking time period $H_2$ equals to number of pixels in each of the second horizontal blanking pixel rows such as $HB_{21}$ and $HB_{22}$. And number of pixels corresponding to the second vertical blanking time period $VB_2$ equals to number of pixels in all of the second vertical blanking pixel rows such as $VB_{21}$ and $VB_{22}$.

The second active pixel time period $A_2$ of the second timing signal $PCLK_2$ is the same as the first active pixel time period $A_1$ of the first timing signal $PCLK_1$. However, the second horizontal blanking time period H2 of the second timing signal $PCLK_2$ is shorter than the first horizontal blanking time period $H_1$ of the first timing signal $PCLK_1$. Hence, the pixel number of each of the second horizontal blanking pixel rows such as $HB_{21}$ and $HB_{22}$ is less than that of each of the first horizontal blanking pixel rows such as $HB_{11}$ and $HB_{12}$.

In one embodiment, the sum (called the first sum of pixel) of pixel numbers of the first active pixel area $AP_1$, the first horizontal blanking area $HB_1$, and the first vertical blanking area $VB_1$ equals to the sum (called the second sum of pixel) of pixel numbers of the first active pixel area $AP_2$, the first horizontal blanking area $HB_2$, and the first vertical blanking area $VB_2$. Hence, the difference of pixel numbers between the first horizontal blanking area $HB_1$ and first horizontal blanking area $HB_2$ can be shifted to the second vertical blanking area $VB_2$ for compensation. Embodiments below will describe in details about how to determine row number of the second vertical blanking pixel rows of the second vertical blanking area $VB_2$.

As shown in FIG. 4 and FIG. 5, since the second active pixel time period $A_2$ is the same as the first active pixel time period $A_1$ of the first timing signal PCLK1 and the second horizontal blanking time period $H_2$ is shorter than the first horizontal blanking time period $H_1$, the total time for transmitting active pixels according to the second timing signal $PCLK_2$ (i.e., sum of all $A_2$ and $H_2$) is shorter than the total time for transmitting active pixels according to the first timing signal $PCLK_1$. Therefore, it improves the crosstalk phenomenon of the prior art.

In some embodiments, it may not be possible to equally distribute the shifted horizontal blanking pixels to each of the second vertical blanking pixel rows. For example, if there are 1000 pixels to be distributed to the second vertical blanking area and the pixel count of each second vertical blanking pixel row is 100, ten second vertical blanking pixel rows can be added for the compensation of the 1000 horizontal blanking pixels. However, if there are 1020 pixels to be distributed and the pixel count of each second vertical blanking pixel row is 100, it is not possible to equally distribute the 1020 horizontal blanking pixels to additional second vertical blanking pixel rows. There are undistributed remainder pixels, 20 pixels, in this case. So following approaches according to the present invention are provided for this case.

Figure 7:
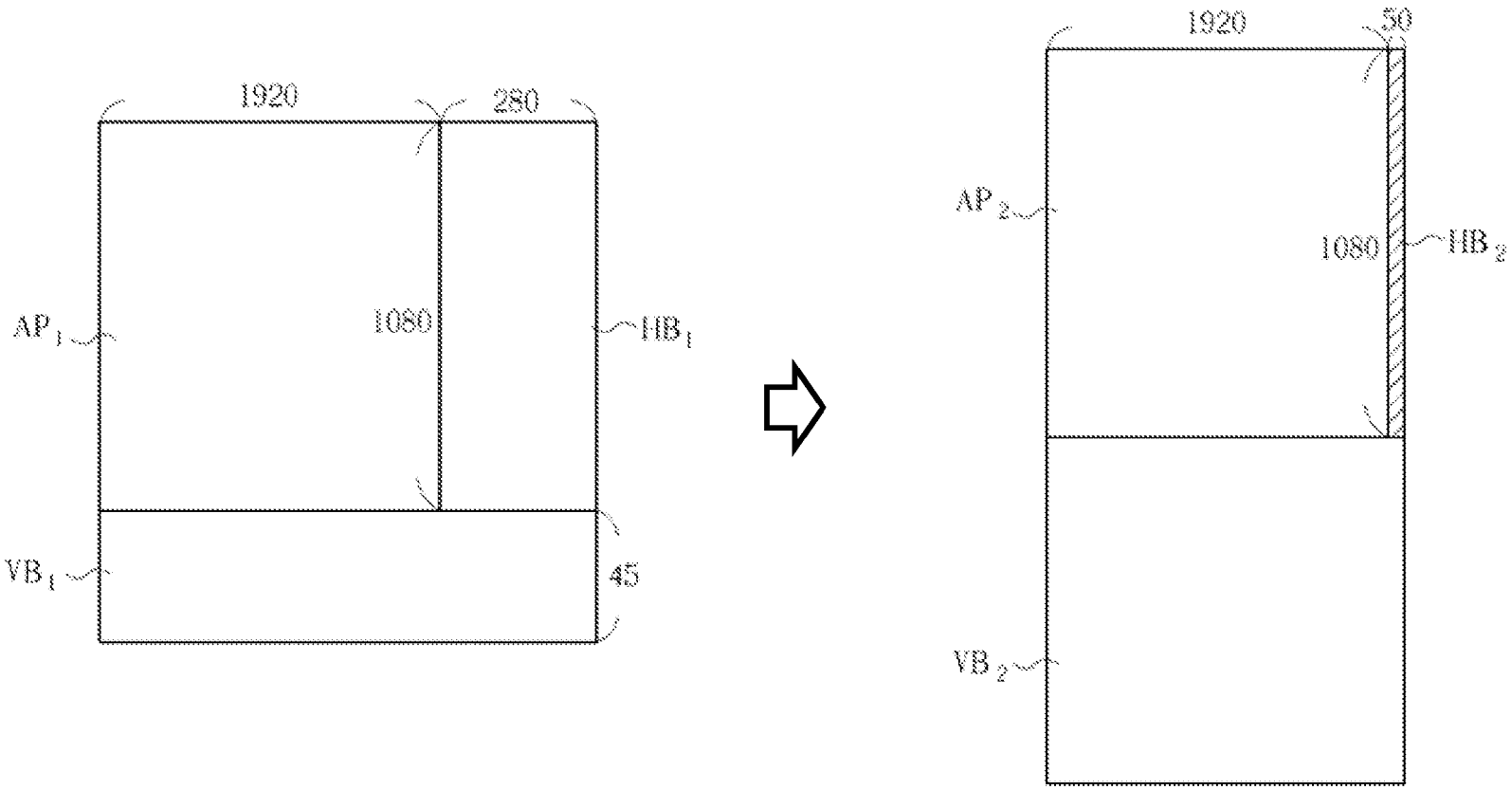
FIG. 7 and FIG. 8 depict exemplary diagrams showing how to adjust the number of vertical blanking pixel rows according to the number of remainder pixels.
Figure 8:
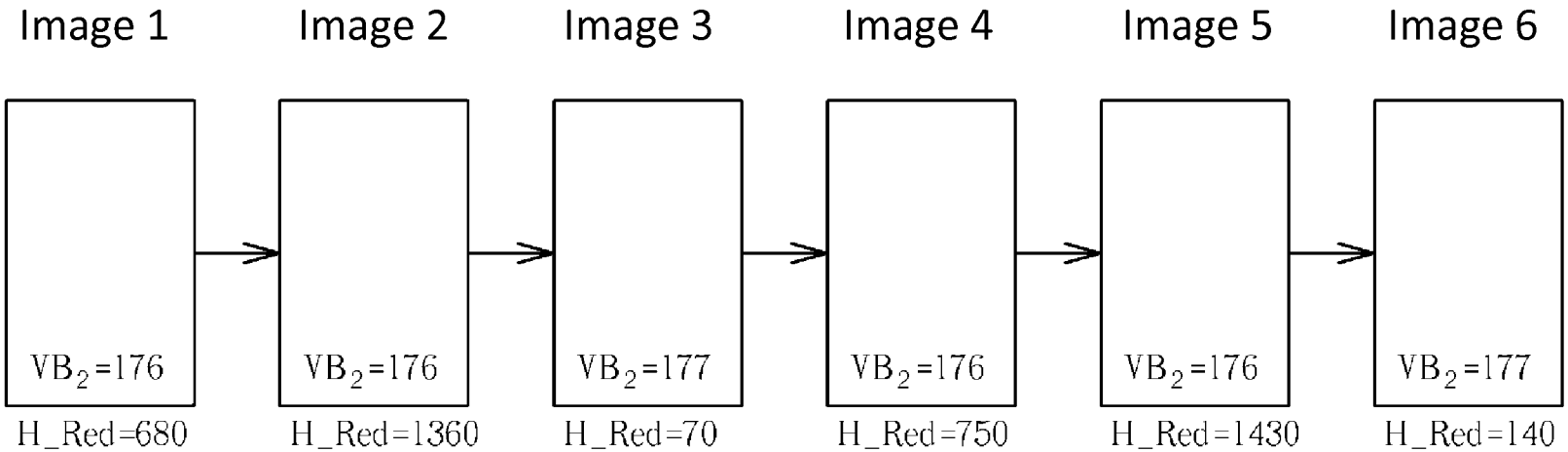

FIG. 7 and FIG. 8 depict exemplary diagrams showing how to adjust the number of vertical blanking pixel rows according to the number of remainder pixels. As shown in the FIG. 7, the pixel number of a first active pixel row is 1920, the pixel number of a first horizontal blanking pixel row is 280, the row number of first active pixel rows is 1080, and the row number of first vertical blanking pixel rows is 45. Therefore, a first sum of pixels is 2475000 which is obtained from (1920+280)×(1080+45). If the pixel number of a second active pixel row is still 1920, the row number of the second active pixel rows is also still 1080, and the pixel number of each of the second horizontal blanking pixel rows is assumed to be 50, the total pixel number of the second active pixel area $AP_2$ and the second horizontal blanking area $HB_2$ is 2127600 which is obtained from (1920+50)×1080. In the consequence, the number of pixels to be distributed to the second vertical blanking area $VB_2$ is 347400. In this case, the pixel number of the second vertical blanking pixel row is 1970 which is the sum of the pixel number, 1920, of one second active pixel row and the pixel number, 50, of one second horizontal blanking pixel row. Therefore, the row number of the second vertical blanking pixel rows can be calculated by dividing the pixels to be distributed by the pixel number of the second vertical blanking pixel row, 347400/1970, and is equal to 176 in this case. And the remainder 680 of the division is the remainder pixel number H_Red.

FIG. 8 depicts a diagram showing an embodiment in accordance with the image processing method of the present invention. The parameters of the images are the same as shown in the FIG. 7. When processing Image 1, the row number of the second vertical blanking pixel row is 176 and the remainder is 680. The number 680 is stored in the register 305 temporarily as the remainder pixel number H_Red. Since the number, 680, is smaller than the pixel number, 1970, of the second vertical blanking pixel row, no additional second vertical blanking pixel row is increased. When processing Image 2, the row number of the second vertical blanking pixel row is 176 and the remainder is 680, too. The remainder, 680, is accumulated to the register 305, so that the remainder pixel number H_Red is accumulated as 1360 which is smaller than the pixel number, 1970, of the second vertical blanking pixel row. Therefore, no additional second vertical blanking pixel row is increased. When processing Image 3, the row number of the second vertical blanking pixel row is 176 and the remainder pixel count is 680, too. However, the remainder pixel number H_Red is accumulated to 2040 which is larger than the pixel number, 1970, of the second vertical blanking pixel row. Therefore the row number of the second vertical blanking pixel rows is increased to 177, and the remainder pixel number H_Red, 2040, is subtracted by 1970 to become to 70. And so on, the row number of the second vertical blanking pixel row is 176 and the remainder pixel number H_Red is 750 corresponding to Image 4. The row number of the second vertical blanking pixel row is 176 and the remainder pixel number H_Red is 1430 corresponding to Image 5. When processing Image 6, since the accumulated remainder pixel number H_red is 2110 exceeding the pixel number, 1970, of the second vertical blanking pixel row, the row number of the second vertical blanking pixel rows is increased to 177 and the remainder pixel count H_red becomes 140. Alternatively, the remainder pixel number H_red can be accumulated to more than pixel number of X rows of the second vertical blanking pixel rows, and then increase X rows to the second vertical blanking pixel rows at once. Wherein X is an integer more than one. Please be aware that the register 305 shown in the FIG. 3 can be located anywhere. It is also acceptable to integrate the register 305 into the controller 301 or the buffer 303.

Therefore, the embodiment shown in the FIG. 7 and FIG. 8 can determine the row number of the second vertical blanking pixel rows according to the following formula:

$$Hd/Vt=M+Q$$

where Ha is a difference between a total pixel number corresponding to all the first active pixel time periods (i.e. pixel number of the first active pixel area $AP_1$), all the first horizontal blanking time periods (i.e. pixel number of the first horizontal blanking area $HB_1$), and the first vertical blanking time period (i.e. pixel number of the first vertical blanking area $VB_1$) in one cycle of the first timing signal and a total pixel number corresponding to all the second active pixel time periods (i.e. pixel number of the second active pixel area $AP_2$) and all the second horizontal blanking time periods (i.e. pixel number of the second horizontal blanking area $HB_2$) in one cycle of the second timing signal. Where Vt is the pixel number of each second vertical blanking row corresponding to the second vertical blanking time period, which is 1970 in the embodiment shown in the FIG. 7. Where M is the quotient of the division Hd/Vt, and Q is the remainder of the division Hd/Vt. If M is equal to or larger than 1, M is the row number of the second vertical blanking pixel rows. If Q is not zero, a remainder pixel number H_Red is accumulated by Q and stored.

And, each time receiving the image according to the first timing signal and outputting the image according to the second timing signal, the value Q is accumulated to the remainder pixel number H_Red. If the remainder pixel number H_Red is not larger than the value of $V_t$, M is set to be the row number of the second vertical blanking pixel rows, such as Images 1, 2, 4, and 5 shown in the FIG. 8. If the remainder pixel number H_Red exceeds the value of $V_t$, N second vertical blanking pixel rows are added and the remainder pixel number H_Red is subtracted by the multiplication of $V_t$ and N, where N is an positive integer, such as Image 3 and 6 shown in the FIG. 8. In these embodiments, the total pixel numbers of the image frame before and after adjustment are not the same. However, the difference can be adjusted below a predetermined value. It would not cause big problems to image transmission timing.

Figure 9:
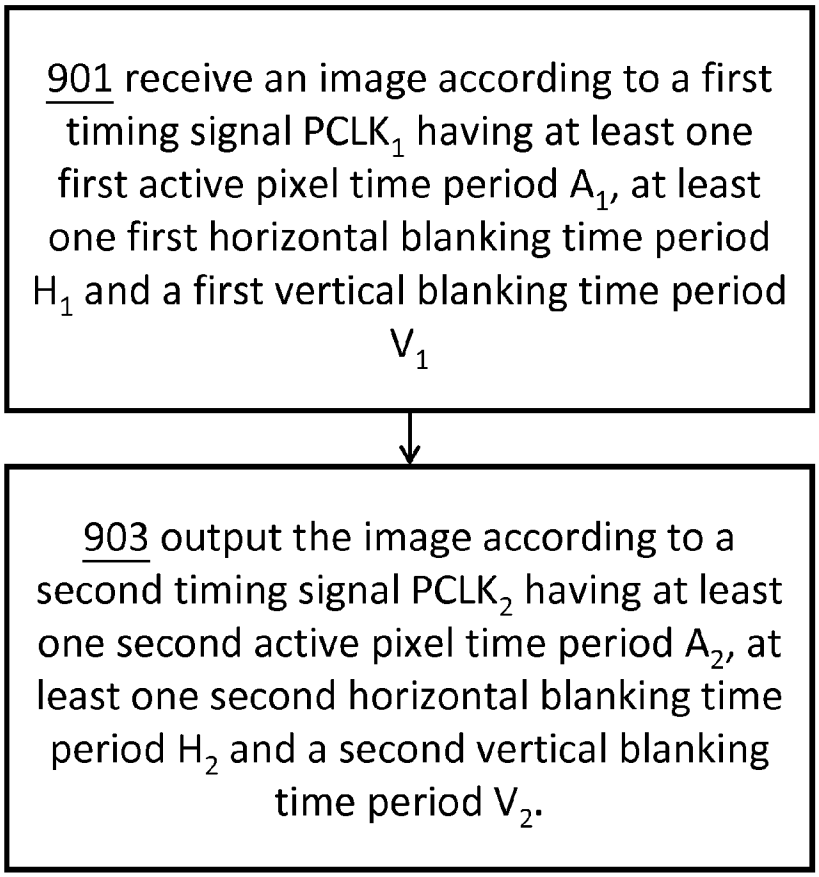
FIG. 9 shows a diagram of an image processing method according to an embodiment of the present invention.

According to embodiments mentioned above, the flowchart diagram shown in the FIG. 9 can be concluded. The flow comprises the following steps:

Step 901: receiving an image according to a first timing signal PCLK1 having at least one first active pixel time period $A_1$, at least one first horizontal blanking time period $H_1$ and a first vertical blanking time period $V_1$.

Step 903: outputting the image according to a second timing signal $PCLK_2$ having at least one second active pixel time period $A_2$, at least one second horizontal blanking time period $H_2$ and a second vertical blanking time period $V_2$.

The pixel number corresponding to the first active pixel time period $A_1$ equals to the pixel number corresponding to the second active pixel time period $A_2$. The pixel number corresponding to the second vertical blanking time periods $H_2$ is less than the pixel number corresponding to the first vertical blanking time periods $H_1$. And the pixel number corresponding to the second vertical blanking time period $V_2$ is larger than the pixel number corresponding to the first vertical blanking time period $V_1$.

The rest of technical features are already discussed in the embodiments above. So there is no more duplicated descriptions here.

By shortening the horizontal blanking time period, the rising or falling of signal voltage level between different data happens earlier accordingly. When the backlight module is turned on, the eyes perceive more latter data (data B) and less former data (data A). So the crosstalk phenomenon is alleviated accordingly. By this way, the crosstalk issue can be improved in the consequence. Moreover, approaches for determining the number of vertical blanking pixel rows according to the remainder pixels is disclosed, the present invention provides more design flexibility.

The above embodiments are only used to illustrate the principles of the present invention, and they should not be construed as to limit the present invention in any way. The above embodiments can be modified by those with ordinary skill in the art without departing from the scope of the present invention as defined in the following appended claims.

What is claimed is:

1. An image processing method, comprising:

receiving an image according to a first timing signal having at least one first active pixel time period, at least one first horizontal blanking time period and a first vertical blanking time period; and outputting the image according to a second timing signal having at least one second active pixel time period, at least one second horizontal blanking time period and a second vertical blanking time period, wherein a pixel number corresponding to the first active pixel time period equals to a pixel number corresponding to the second active pixel time period, the second horizontal blanking time period is less than the first horizontal blanking time period, and the second vertical blanking time period is larger than the first vertical blanking time period.

2. The image processing method of claim 1, wherein a difference between a pixel number corresponding to one cycle of the first timing signal and a pixel number corresponding to one cycle of the second timing signal is less than a predetermined value.

3. The image processing method of claim 2, wherein the pixel number corresponding to the one cycle of the first timing signal equals to the pixel number corresponding to the one cycle of the second timing signal.

4. The image processing method of claim 2, wherein a row number corresponding to the second vertical blanking time period is determined according to the following formula:

$$H_d/V_t=M+Q$$

where $H_d$ is a difference between a total pixel number corresponding to all the at least one first active pixel time period, all the at least one first horizontal blanking time period, and the first vertical blanking time period in one cycle of the first timing signal and a total pixel number corresponding to all the at least one second active pixel time period and all the at least one second horizontal blanking time period in one cycle of the second timing signal, where $V_t$ is a pixel number of one of rows corresponding to the second vertical blanking time period, where M is a quotient of the division $H_d/V_t$ and Q is a remainder of the division $H_d/V_t$;

wherein if M is equal to or larger than 1, M is the row number corresponding to the second vertical blanking time period, and if Q is not equal to zero, a remainder pixel number is accumulated by Q and stored.

5. The image processing method of claim 4, further comprising:

accumulating the remainder pixel number by Q each time when receiving the image according to the first timing signal and outputting the image according to the second timing signal are performed; and setting M to be the row number when the remainder pixel number is not larger than the value of $V_t$, otherwise, setting M+N to be the row number when the remainder pixel number is larger than the value of $V_t$, and subtracting the multiplication of $V_t$ and N from the remainder pixel number, where N is an positive integer.

6. The image processing method of claim 4, wherein the value of $V_t$ equals to a sum of a pixel number corresponding to one of the at least one second active pixel time period and a pixel number corresponding to one of the at least one second horizontal blanking time period.

7. An image processing apparatus, comprising:

a storage; and a controller, configured to control the storage for receiving an image according to a first timing signal having at least one first active pixel time period, at least one first horizontal blanking time period and a first vertical blanking time period, and to control the storage for outputting the image according to a second timing signal having at least one second active pixel time period, at least one second horizontal blanking time period and a second vertical blanking time period, wherein a pixel number corresponding to the first active pixel time period equals to a pixel number corresponding to the second active pixel time period, the second horizontal blanking time period is less than the first horizontal blanking time period, and the second vertical blanking time period is larger than the first vertical blanking time period.

8. The image processing apparatus of claim 7, wherein a difference between a pixel number corresponding to one cycle of the first timing signal and a pixel number corresponding to one cycle of the second timing signal is less than a predetermined value.

9. The image processing apparatus of claim 8, wherein the pixel number corresponding to the one cycle of the first timing signal equals to the pixel number corresponding to the one cycle of the second timing signal.

10. The image processing apparatus of claim 8, wherein the controller determines a row number corresponding to the second vertical blanking time period according to the following formula:

$$H_d/V_t=M+Q$$

where $H_d$ is a difference between a total pixel number corresponding to all the at least one first active pixel time period, all the at least one first horizontal blanking time period, and the first vertical blanking time period in one cycle of the first timing signal and a total pixel number corresponding to all the at least one second active pixel time period and all the at least one second horizontal blanking time period in one cycle of the second timing signal, where $V_t$ is a pixel number of one of rows corresponding to the second vertical blanking time period, where M is a quotient of the division $H_d/V_t$ and Q is a remainder of the division $H_d/V_t$;

wherein if M is equal to or larger than 1, M is the row number corresponding to the second vertical blanking time period, and if Q is not equal to zero, a remainder pixel number is accumulated by Q and stored.

11. The image processing apparatus of claim 10, wherein the controller is further configured to accumulate the remainder pixel number by Q each time when receiving the image according to the first timing signal and outputting the image according to the second timing signal are performed; and set M to be the row number when the remainder pixel number is not larger than the value of $V_t$, otherwise, setting M+N to be the row number when the remainder pixel number is larger than the value of $V_t$, and subtracting the multiplication of $V_t$ and N from the remainder pixel number, where N is an positive integer.

12. The image processing apparatus of claim 10, wherein the value of $V_t$ equals to a sum of a pixel number corresponding to one of the at least one second active pixel time period and a pixel number corresponding to one of the at least one second horizontal blanking time period.

* * * * *